US008578684B2

(12) United States Patent
Greenland

(10) Patent No.: US 8,578,684 B2
(45) Date of Patent: Nov. 12, 2013

(54) UNITIZED PACKAGE AND METHOD OF MAKING SAME

(75) Inventor: Steven J. Greenland, Hampton, NH (US)

(73) Assignee: AKI, Inc. NY (US)

( * ) Notice: Subject to any disclaimer, the term of this patent is extended or adjusted under 35 U.S.C. 154(b) by 0 days.

(21) Appl. No.: 13/423,692

(22) Filed: Mar. 19, 2012

(65) Prior Publication Data

US 2012/0178603 A1 Jul. 12, 2012

Related U.S. Application Data

(62) Division of application No. 12/857,587, filed on Aug. 17, 2010.

(60) Provisional application No. 61/236,425, filed on Aug. 24, 2009.

(51) Int. Cl.
*B65B 61/00* (2006.01)

(52) U.S. Cl.
USPC ..... 53/410; 53/434; 53/453

(58) Field of Classification Search
USPC ..... 53/410, 434, 453
See application file for complete search history.

(56) References Cited

U.S. PATENT DOCUMENTS

| | | | |
|---|---|---|---|
| 2,552,870 | A | 5/1951 | Scherer |
| 2,648,463 | A | 8/1953 | Scherer |
| 2,705,579 | A | 4/1955 | Mason |
| 2,707,581 | A | 5/1955 | Kaplan |
| 2,717,174 | A | 9/1955 | Casanovas |
| RE24,251 | E | 12/1956 | Kaplan et al. |
| 2,956,710 | A | 10/1960 | O'Connor |
| 2,962,192 | A | 11/1960 | Volckening |
| 3,116,077 | A | 12/1963 | Bird |
| 3,184,121 | A | 5/1965 | Volckening |

(Continued)

FOREIGN PATENT DOCUMENTS

| | | | |
|---|---|---|---|
| AR | 024191 | A1 | 9/2002 |
| AR | 027778 | A1 | 4/2003 |

(Continued)

OTHER PUBLICATIONS

*Dispersions—Paramelt—Waxes, Adhesives & Dispersions*, http://www.paramelt.com/markets.and.products.Dispersions.htm, Sep. 26, 2008.

(Continued)

*Primary Examiner* — Hemant M Desai
(74) *Attorney, Agent, or Firm* — Jones Day

(57) ABSTRACT

The invention generally relates to unitized packages and a method of manufacturing the unitized packages for containing and dispensing a product material. In particular, the unitized packages comprise a printed base card and a fluid vessel permanently bonded to the printed base card. The fluid vessel comprises a first laminate barrier layer comprising at least one layer of a biaxially oriented thermoplastic polymer, a portion of which is formed into a modified dome shape, and a planar second laminate barrier layer. The first and second laminate barrier layers are sealed together to form a fluid-tight enclosure, wherein the product material substantially fills the enclosure and the modified dome shape is resiliently sustainable. In particular, the method includes forming a portion of the first laminate barrier layer comprising the biaxially oriented polymer into the modified dome shape using a force such as pressurized gas.

19 Claims, 3 Drawing Sheets

(56) References Cited

U.S. PATENT DOCUMENTS 3,278,085 A 10/1966 Brown
3,307,281 A 3/1967 Mateo
3,334,790 A 8/1967 Eaton
3,414,414 A 12/1968 Christine et al.
3,450,256 A 6/1969 Chandler et al.
3,456,784 A 7/1969 Sirago
3,616,898 A 11/1971 Massie
3,630,346 A 12/1971 Burnside
3,655,129 A 4/1972 Seiner
3,741,384 A 6/1973 Cloud
3,749,236 A 7/1973 Dahl
3,858,807 A 1/1975 Rabussier et al.
3,913,734 A 10/1975 Siegel
3,917,116 A 11/1975 Mason
4,094,119 A 6/1978 Sullivan
4,145,001 A 3/1979 Weyenberg et al.
4,155,454 A 5/1979 Ryden
4,168,002 A 9/1979 Crosby
4,209,096 A 6/1980 Carkhuff
4,277,024 A 7/1981 Spector
4,283,011 A 8/1981 Spector
4,356,969 A 11/1982 Obermayer et al.
4,369,885 A 1/1983 Redmond
4,415,084 A 11/1983 Hauser et al.
4,484,768 A 11/1984 Norfleet
4,487,801 A 12/1984 Turnbull et al.
4,603,069 A 7/1986 Haq et al.
4,612,223 A 9/1986 Spector
4,648,506 A 3/1987 Campbell
4,696,844 A 9/1987 Spector
4,717,017 A 1/1988 Sprinkel, Jr. et al.
4,720,409 A 1/1988 Spector
4,720,417 A 1/1988 Sweeny et al.
4,739,778 A 4/1988 Christie
4,751,934 A 6/1988 Moir et al.
4,753,389 A 6/1988 Davis
4,814,212 A 3/1989 Spector
4,824,143 A 4/1989 Grainger
4,824,707 A 4/1989 Spector
4,848,378 A 7/1989 Moir et al.
4,871,091 A 10/1989 Preziosi
4,874,129 A 10/1989 DiSapio et al.
4,880,690 A 11/1989 Szycher et al.
4,889,755 A 12/1989 Charbonneau
4,898,328 A 2/1990 Fox et al.
4,908,252 A 3/1990 Carnahan et al.
4,921,137 A 5/1990 Heijenga
4,923,063 A 5/1990 Tararuj
4,925,517 A 5/1990 Charbonneau et al.
RE33,299 E 8/1990 Sweeny et al.
4,998,621 A 3/1991 Meehan
5,009,894 A 4/1991 Hsiao
5,050,909 A 9/1991 Mertens et al.
5,050,910 A 9/1991 Schechter et al.
5,071,704 A 12/1991 Fischel-Ghodsian
5,093,182 A 3/1992 Ross
5,111,932 A 5/1992 Campbell
5,161,688 A 11/1992 Muchin
5,188,236 A 2/1993 Sayers et al.
5,192,386 A 3/1993 Moir et al.
5,242,521 A 9/1993 Hibsch et al.
5,248,537 A 9/1993 Giannavola
5,249,676 A 10/1993 Ashcraft et al.
5,304,358 A 4/1994 Hoyt et al.
5,307,934 A 5/1994 Hagner
5,341,992 A 8/1994 Bishopp
5,342,420 A 8/1994 Bosses
5,380,110 A 1/1995 Festa
5,389,174 A 2/1995 Hibsch et al.
5,391,420 A 2/1995 Bootman et al.
5,395,047 A 3/1995 Pendergrass, Jr.
5,419,958 A 5/1995 Charbonneau
5,439,172 A 8/1995 Comyn et al.
5,445,821 A 8/1995 Brown et al.
5,455,043 A 10/1995 Fischel-Ghodsian
5,529,224 A 6/1996 Chan et al.
5,535,885 A 7/1996 Daniel et al.
5,562,112 A 10/1996 Gunderman et al.
5,568,866 A 10/1996 Grosskopf et al.
5,577,947 A 11/1996 Malloy et al.
5,609,710 A 3/1997 Charbonneau
5,622,263 A 4/1997 Greenland
5,632,416 A * 5/1997 Lane, Jr. et al. ..... 222/105
5,645,161 A 7/1997 Whitaker et al.
5,647,941 A 7/1997 Gunderman et al.
5,690,130 A 11/1997 Gunderman et al.
5,715,849 A 2/1998 Vanbraekel
5,716,000 A 2/1998 Fox
5,782,060 A 7/1998 Greenland
5,839,609 A 11/1998 Zakensberg
5,879,769 A 3/1999 Greenland et al.
5,885,701 A 3/1999 Berman et al.
5,899,382 A 5/1999 Hayes et al.
5,904,028 A 5/1999 Fujiura
5,908,208 A 6/1999 Lapsker
5,928,748 A 7/1999 Jones et al.
5,944,188 A 8/1999 Grosskopf et al.
5,953,885 A 9/1999 Berman et al.
5,980,960 A 11/1999 Amitai
6,006,916 A 12/1999 Matsos et al.
6,085,942 A 7/2000 Redmond
6,103,040 A 8/2000 Hunkeler
6,125,614 A 10/2000 Jones et al.
6,182,420 B1 2/2001 Berman et al.
6,213,303 B1 4/2001 Harris et al.
6,245,176 B1 6/2001 Greenland
6,250,049 B1 * 6/2001 Feldman et al. ..... 53/452
6,251,408 B1 6/2001 Dobler
6,261,347 B1 7/2001 Moreland
6,287,652 B2 9/2001 Speckhals et al.
6,301,860 B1 * 10/2001 Gunderman et al. ..... 53/410
6,326,069 B1 12/2001 Barnett et al.
6,348,246 B1 2/2002 Finestone et al.
6,364,097 B1 4/2002 Whitaker et al.
6,378,274 B1 * 4/2002 Harbour ..... 53/453
6,403,186 B1 6/2002 Tararuj et al.
6,461,620 B2 10/2002 Dobler
6,541,052 B1 4/2003 Rohleder
6,557,731 B1 5/2003 Lyon et al.
6,612,429 B2 9/2003 Dennen
6,656,256 B2 12/2003 Moreland
6,686,013 B1 2/2004 Tebbe
6,688,467 B2 * 2/2004 Krupka et al. ..... 206/469
6,691,872 B1 2/2004 Berman et al.
6,705,541 B2 3/2004 Schuehrer et al.
6,726,797 B2 4/2004 Tararuj et al.
6,736,335 B2 5/2004 Cuthbert
6,929,128 B2 * 8/2005 Caldwell et al. ..... 206/466
7,213,770 B2 5/2007 Martens, III et al.
7,241,066 B1 7/2007 Rosen et al.
7,348,024 B2 3/2008 Tararuj
7,677,015 B2 * 3/2010 Kroese et al. ..... 53/453
8,141,709 B2 3/2012 Klaus
2001/0009175 A1 7/2001 Speckhals et al.
2001/0023017 A1 9/2001 Tararuj et al.
2002/0157983 A1 10/2002 Krupka et al.
2002/0185401 A1 12/2002 Duquet et al.
2003/0085298 A1 5/2003 Schuehrer et al.
2003/0213724 A1 11/2003 Dobler
2005/0011794 A1 * 1/2005 Caldwell et al. ..... 206/466
2005/0061710 A1 3/2005 Dobler
2005/0196571 A1 9/2005 Penny et al.
2006/0021901 A1 2/2006 Dobler et al.
2006/0263579 A1 11/2006 Field, Jr.
2007/0014992 A1 1/2007 Longmoore
2007/0068845 A1 3/2007 Schuehrer
2007/0228073 A1 10/2007 Mazzarino
2007/0243239 A1 10/2007 Lanser
2007/0251131 A1 11/2007 Majerowski

(56) References Cited

U.S. PATENT DOCUMENTS

| | | | |
|---|---|---|---|
| 2008/0000786 | A1 | 1/2008 | Collotta et al. |
| 2008/0011319 | A1 | 1/2008 | Ripoli |
| 2009/0050506 | A1 | 2/2009 | Dobler |
| 2009/0071978 | A1 | 3/2009 | Sharp et al. |
| 2009/0071979 | A1 | 3/2009 | Sharp et al. |
| 2010/0163447 | A1 | 7/2010 | Greenland |

FOREIGN PATENT DOCUMENTS

| | | |
|---|---|---|
| DE | 3122237 | 1/1983 |
| DE | 29918311 | 1/2000 |
| DE | 20102282 | 6/2001 |
| DE | 20111705 | 10/2001 |
| DE | 20214971 | 1/2003 |
| DE | 20114352 | 2/2003 |
| DE | 202004000591 | 4/2004 |
| DE | 202004007692 | 8/2004 |
| DE | 202005003504 | 6/2005 |
| DE | 202005010301 | 11/2005 |
| DE | 102007044829 | 3/2009 |
| EP | 0263327 | 9/1987 |
| EP | 0722676 | 7/1996 |
| EP | 0963715 | 12/1999 |
| EP | 1078865 | 2/2001 |
| EP | 1234521 | 8/2002 |
| EP | 1295613 | 3/2003 |
| FR | 2796368 | 1/2001 |
| GB | 2390841 | 1/2004 |
| NL | 1021615 | 6/2004 |
| WO | WO 92/14607 | 9/1992 |
| WO | WO 93/24031 | 12/1993 |
| WO | WO 94/12072 | 6/1994 |
| WO | WO 98/01361 | 1/1998 |
| WO | WO 98/48659 | 11/1998 |
| WO | WO 99/39907 | 8/1999 |
| WO | WO 99/47431 | 9/1999 |
| WO | WO 2004/030821 | 4/2004 |
| WO | WO 2005/027684 | 3/2005 |

OTHER PUBLICATIONS

*Dow Epoxy : Waterborne Mechanical Dispersions of Polyolefins*, http://epoxy.dow.com/epoxy/news/trade.htm, Mar. 2006.

Dow Introduces HYPOD™ Polyolefin Dispersions, *Breakthrough Technology Used to Make Waterborne Dispersions of Polymers*, http://news.dow.com/prodbus/2007/20070711b.htm, Midland, MI—Jul. 11, 2007.

European Search Report mailed Dec. 6, 2010 for EP 10173101.6-2308.

HYPOD Polyolefin Dispersions Offer Balance of Sustainability and Performance, http://news.dow.com/prodbus/2008/20080801a.htm, Midland, MI—Aug. 1, 2008.

International Search Report mailed Feb. 9, 2010 for International Application No. PCT/US2009/069631, filed Dec. 29, 2009.

International Search Report mailed Oct. 6, 2010 for International Application No. PCT/US2010/045719, filed Aug. 17, 2010.

*Michelman—Your Competitive Edge™—Michem Dispersion*, http://www.michem.com/Products/Michem-Dispersion, Sep. 26, 2008.

*New Polyolefin Dispersions Offer Environmentally Preferable Option in Carpet Backing. Dow to showcase enabling BLUEWAVETM Technology at Greenbuild Expo 2007*, http://news.dow.com/dow_news/prodbus/2007/20071107b.htm, Chicago, IL—Nov. 7, 2007.

Non-final Office Action mailed Dec. 27, 2010 for U.S. Appl. No. 12/648,324, filed Dec. 29, 2009.

Non-final Office Action mailed Oct. 1, 2010 for U.S. Appl. No. 12/262,082, filed Oct. 30, 2008.

Office Action mailed Jul. 11, 2011 for U.S. Appl. No. 12/262,082, filed Oct. 30, 2008.

Office Action mailed Jul. 21, 2011 for U.S. Appl. No. 12/648,324, filed Dec. 29, 2009.

Office Action mailed Dec. 29, 2011 for U.S. Appl. No. 12/857,587, filed Aug. 17, 2010.

Office Action mailed Jun. 21, 2012 for U.S. Appl. No. 12/857,587, filed Aug. 17, 2010.

Office Action mailed Jun. 1. 2012 for U.S. Appl. No. 12/262,082, filed Oct. 30, 2008.

HYPOD Polyolefin Dispersions, http://www.dow.com/dowpod/, Sep. 26, 2008.

* cited by examiner

UNITIZED PACKAGE AND METHOD OF MAKING SAME

RELATED APPLICATIONS

This application is a divisional of U.S. patent application Ser. No. 12/857,587, filed Aug. 17, 2010, which claims priority to U.S. Provisional Patent Application Ser. No. 61/236,425, filed Aug. 24, 2009.

FIELD OF THE INVENTION

The invention generally relates to unitized packages for containing and dispensing a product material. In particular, the unitized packages comprise a printed base card and a fluid vessel permanently bonded to a portion of the base card. The fluid vessel comprises a first laminate barrier layer comprising at least one layer of a biaxially oriented thermoplastic polymer, a portion of which is formed into a modified dome shape, and a planar second laminate barrier layer. The invention also relates to methods of making such unitized packages.

BACKGROUND OF THE INVENTION

Squeezable containers are used in packaging and dispensing various formulations of cosmetic, personal care and household products. Metal tubes are an example of such containers. Metal tubes are airtight and therefore afford protection to the product materials contained in the tubes through long periods of storage. However, metal, such as aluminum foil, is difficult to form and the manufacturing of metal tubes is often costly.

Squeezable containers have also been fabricated with plastics. Though relatively inexpensive to manufacture, plastic containers do not provide the same level of protection to the product materials as the metal tubes provide due to the permeability of the plastic. As a result, shelf life of the product materials contained in plastic containers is often shorter.

Flexible packages or pouches, such as those used for condiments, are another example of squeezable plastic container. More recently, small volume pouches have been fabricated to include a header section that is flat and unfilled with the product materials to expand their visual presence and graphic message. However, such flexible pouches have a number of drawbacks. For example, the header section of the flexible pouches lacks sufficient rigidity and causes thermal distortion. Additionally, since the product materials are generally distributed throughout a largely two dimensional area, it is difficult to produce desired fluid flow of the product material toward the opening of the pouches. Dispensing high viscosity fluids is particularly problematic. Due to the lack of any defined three dimensional shape, flexible pouches require a greater surface area to store a given volume of the product material, which is often accompanied by greater vapor transmission through the surface area, a greater tendency for phase separation (particularly if the product material is an emulsion), and a greater potential of losing the product material due to scalping by thermoplastic packages.

In addition, small volume squeezable containers often suffer from lack of visual appeal and difficulty in retail placement. In particular, such squeezable containers lack enough surface area to accommodate textual or graphic messages for promotional or instructional purposes. As a result, they must be packaged with a secondary container such as a printed carton or a blister pack that bears the requisite textual or graphic messages. However, since such squeezable containers must be separated from the secondary container prior to use, the promotional or instructional messages printed on the secondary container are often overlooked or lost prior to the time of use.

There is therefore a need for an improved squeezable package that provides adequate vapor barrier characteristics and shelf life; is capable of maintaining a predetermined shape with sufficient rigidity prior to use; allows dispensing of the product material in a controlled fashion; and ensures the presence of the promotional or instructional messages at the time of use. Also needed is an economical and efficient process for manufacturing such a squeezable package.

SUMMARY OF THE INVENTION

The present invention provides a unitized package which includes a base card and a fluid vessel that is permanently bonded to a portion of the base card.

In one embodiment, the unitized package comprises a printed base card and a fluid vessel. The fluid vessel comprises a first laminate barrier layer comprising at least one layer of a biaxially oriented thermoplastic polymer, a product material, and a second laminate barrier layer. A portion of the first laminate barrier layer is formed into a modified dome shape with a defined volume. The product material substantially fills the defined volume. The first laminate barrier layer and the second laminate barrier layer are sealed together at their perimeters to form a fluid-tight enclosure for containing the product material. The second laminate barrier layer of the fluid vessel is permanently bonded to a portion of the printed base card.

Preferably, the modified dome shape of the first laminate barrier layer is resiliently sustainable when the fluid vessel is sealed.

The biaxially oriented thermoplastic polymer may comprise a polyethylene, a polypropylene, a polyester, a polyamide, a polyarylate, or a mixture thereof. In a preferred embodiment, the biaxially oriented thermoplastic polymer comprises polyethylene terephthalate.

In one embodiment, one or both of the first and second laminate barrier layers comprise a layer of aluminum foil. Preferably, the aluminum foil is less than about 0.001 inches in thickness.

The product material is preferably a liquid.

In another embodiment, the fluid vessel further comprises a dispensing tip. The base card comprises an opening strip defined by a line of perforation that intersects the dispensing tip. Once the opening strip is removed, the product material may be dispensed from the dispensing tip. In a preferred embodiment, the fluid vessel also comprises a planar extension tab formed by the first and second laminate barrier layers. The extension tab encloses the dispensing tip and overlays the opening strip. The dispensing tip also may be reclosable.

Preferably, the base card is less flexible than the first laminate barrier layer of the fluid vessel. The base card may comprise paper stock. Also, one or both surfaces of the base card may be printed with any promotional or instructional messages for marketing or regulatory compliance purposes.

Also provided is a cost effective method of making a unitized package described above. In one embodiment, the method includes providing a printed base card, fabricating a fluid vessel comprising a first laminate barrier layer and a second laminate barrier layer, and permanently bonding the fluid vessel to the printed base card. The fluid vessel is fabricated by: (i) forming a portion of the first laminate barrier layer, which comprises at least one layer of a biaxially oriented thermoplastic polymer, into a modified dome shape with a defined volume; (ii) depositing a product material onto the first laminate barrier layer such that the product material substantially fills the defined volume; (iii) disposing the second laminate barrier layer, which is planar, on the first laminate barrier layer, and (iv) sealing the first and second laminate barrier layers together at their perimeters to form a fluid-tight enclosure for containing the product material. Preferably, the modified dome shape of the first laminate barrier layer is resiliently sustainable when the fluid vessel is sealed.

The biaxially oriented thermoplastic polymer may comprise a polyethylene, a polypropylene, a polyester, a polyimide, a polyarylate, or a mixture thereof. Preferably, the biaxially oriented thermoplastic polymer comprises polyethylene terephthalate.

In one embodiment, one or both of the first and second laminate barrier layers comprise a layer of aluminum foil. Preferably, the aluminum foil is less than about 0.001 inches in thickness.

In one embodiment, the first and second laminate barrier layers are sealed together by heat sealing. In another embodiment, the first and second laminate barrier layers are bonded together using radio frequency energy, sonic energy, or an adhesive.

In a preferred embodiment, the modified dome shape of the first laminate barrier layer is formed by applying gas pressure to a portion of the first laminate barrier layer. The gas pressure may be about 15 psi to about 140 psi, and the gas pressure may be applied for a time period ranging from about 0.01 seconds to about 1.0 seconds.

In another embodiment, the fluid vessel further comprises a dispensing tip. The base card is die cut to form an opening strip defined by a line of perforation. The opening strip, once removed, allows access to the product material from the dispensing tip. In a preferred embodiment, the first and second laminate barrier layers are sealed together at their perimeters to form the fluid-tight enclosure and a planar extension tab. The extension tab encloses the dispensing tip and overlays the opening strip. The dispensing tip also may be reclosable.

The present invention thus provides an improved squeezable package. In particular, a formed biaxially oriented thermoplastic polymer is used to fabricate the present unitized package. A biaxially oriented thermoplastic polymer offers several advantages over other plastic materials traditionally used in thermoformed containers, e.g., it provides for superior barrier characteristics relative to its thickness and cost benefit. However, biaxially oriented thermoplastic polymer is routinely rejected in known forming processes, largely because its use requires a substantially greater force to form into a desired shape and the obtainable formed profile is severely limited.

It has been found that a laminate barrier layer comprising at least one layer of a biaxially oriented thermoplastic polymer can be sufficiently formed using the forming process disclosed herein to provide a modified dome shape without exceeding the ultimate tensile value of the biaxially oriented thermoplastic polymer, thus preserving its superior barrier characteristic. Additionally, the present forming process increases the degree of the biaxial orientation and resistance to further deformation of the biaxially oriented thermoplastic polymer. As a result, the formed modified dome shape can be resiliently sustained by the product material and/or gases contained in the unitized package until the time of use.

DETAILED DESCRIPTION OF THE INVENTION

I. Unitized Packages

The present unitized package generally comprises a printed base card and a fluid vessel permanently bonded to a portion of the base card. The fluid vessel comprises a first laminate barrier layer and a second laminate barrier layer enclosing a product material. The first laminate barrier layer comprises at least one layer of a biaxially oriented thermoplastic polymer, and a portion of the first laminate barrier layer is formed into a modified monolithic dome shape. The second laminate barrier layer is planar.

Figure 1B:
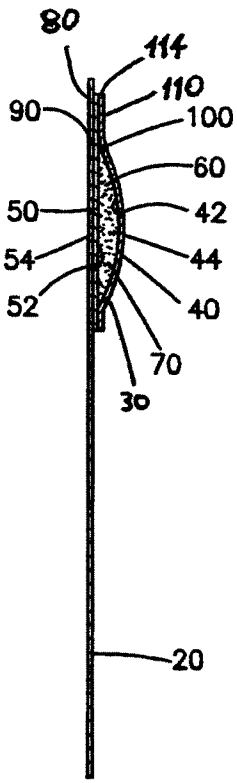
FIG. 1*b* is a cross-sectional view of the unitized package of FIG. 1*a* along A-A.
Figure 1A:
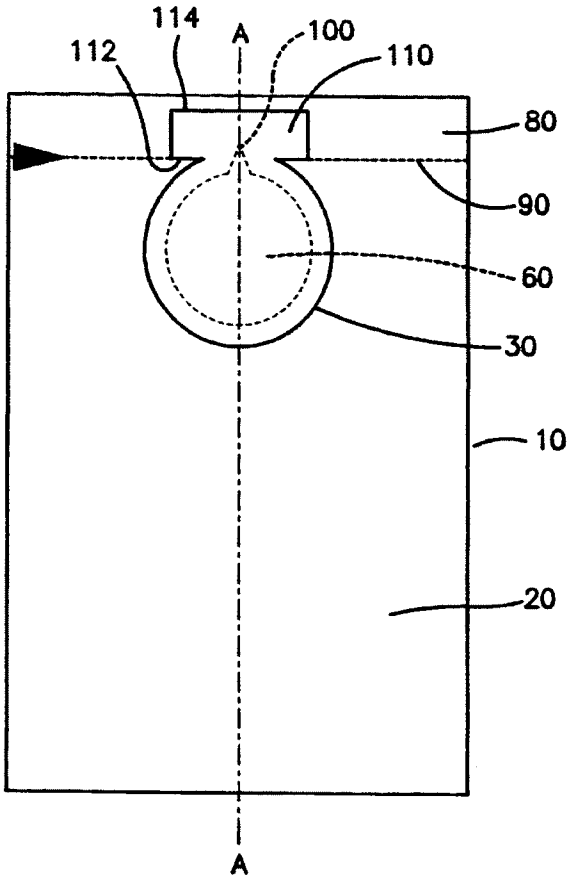
FIG. 1*a* is a plan view of a first embodiment of a unitized package.

FIG. 1*a* shows a first embodiment of the present unitized package. The unitized package 10 includes a printed base card 20 and a fluid vessel 30. FIG. 1*b* shows a cross-sectional view of the unitized package 10 in FIG. 1*a* along A-A. As shown in FIG. 1*b*, the fluid vessel 30 comprises a first laminate barrier layer 40 and a second laminate barrier layer 50. The first laminate barrier layer 40 has an inner surface 42 and an outer surface 44. The second laminate barrier layer 50 has an inner surface 52 and an outer surface 54. The inner surface 42 of the first laminate barrier layer 40 and the inner surface 52 of the second laminate bather layer 50 are sealed together at their perimeters, forming a fluid-tight enclosure 60. A product material 70 substantially fills the volume of the fluid-tight enclosure 60.

The first and second laminate barrier layers are barrier layers, i.e., they are substantially inert and preferably impermeable to the product material contained in the fluid vessel in order to substantially prevent migration of components of the product material through the layers. Various types of plastic film with barrier property, e.g., polyethylene terephtalate ("PET"), celluloses or acetates, may be used to fabricate the laminate barrier layers. The laminate barrier layers may also incorporate specialty vapor barrier coatings to impart or enhance their barrier characteristics. In addition, a material that does not possess barrier properties may be coated or treated in order to give it barrier properties so that the material may be used to form the laminate barrier layers. Depending on the components of the product material, a barrier material may be chosen which is a bather to, for example, oil, gas, water vapor, aroma, or oxygen.

The first laminate barrier layer and the second laminate barrier layer of the unitized package are preferably constructed with thin flexible thermoplastic barrier laminations. The first laminate barrier layer comprises at least one layer of a biaxially oriented thermoplastic polymer. A biaxially oriented thermoplastic polymer is a polymer that has been stretched in two directions (i.e., the machine direction and cross-machine direction) under conditions that result in the reorientation of the polymer. As a result of such polymer orientation, the barrier characteristics and the physical strength of the polymer are improved. A biaxially oriented thermoplastic polymer has a substantially high tensile strength in either machine or cross machine direction, and is generally resistant to further elongation.

Suitable biaxially oriented thermoplastic polymers include, but are not limited o, polyesters, polyamides which includes nylons and amorphous polyamides, polyarylates, polypropylenes, polyethylenes, or mixtures thereof.

A preferred biaxially oriented thermoplastic polymer is a polyester such as polyethylene terephthalate (PET), sold under the trade name MYLAR® manufactured by DuPont Tejlin Films, due to the comparable strength and elongation characteristics of the polyester film along both machine and cross machine directions. Other preferred biaxially oriented thermoplastic polymers include, but are not limited to, polyamides such as nylon film, sold under the trade name Capran Emblem® manufactured by Honeywell, and biaxially oriented polypropylene films (BOPP) such as those manufactured by Exxon-Mobil.

In addition, the first and second laminate barrier layers may each comprise more than one layer of composite materials.

The first and second laminate barrier layers may also each incorporate metallic, semi metallic, metal oxide or ceramic materials to improve the moisture-vapor characteristics of these layers. Examples of such lamination construction may include those manufactured in accordance with U.S. Military specification Mil-B-131 Class I, as well as many commercial laminations such as those used for medical diagnostic testing or distribution of food service condiments.

In one embodiment, the first and the second laminate barrier layers may each comprise a layer of thin gage metal. The metal layer, such as an aluminum foil layer, provides for low moisture vapor transmission rates that are desired in squeezable containers. Any aluminum grades may be used, though those that are more malleable are preferred. A particularly preferred aluminum is a thin gage aluminum layer which does not cause loss of the desirable resilient characteristics of the sealed fluid vessel, is not easily dented or otherwise damaged in transportation, and yet provides the desired reduction in moisture vapor or oxygen transmission rate.

In one embodiment, the first laminate barrier layer may comprise an inner thermoplastic heat seal layer with thickness in the range of about 0.0005 inches to about 0.0040 inches and an outer layer of a biaxially oriented thermoplastic polymer film with thickness in the range of about 0.0004 inches to about 0.002 inches. A supplemental barrier layer, preferably an aluminum foil layer, with thickness in the range of about 0.00027 inches to about 0.001 inches may also be included between the heat seal layer and biaxially oriented thermoplastic film. Preferably, the outer layer is constructed with a biaxially oriented polyester polymer film with thickness in the range of about 0.00048 inches to about 0.00092 inches.

The second laminate barrier layer may have the same or different compositions as the first laminate barrier layer. Because the second laminate barrier layer is not formed, use of a biaxially oriented thermoplastic film in the structure is not required.

As shown in FIG. 1*b*, the first laminate barrier layer 40 has a modified monolithic dome shape formed therein. The terms "modified monolithic dome shape" or "modified dome shape", as used in this application, refer to any suitable three-dimensional protrusion with a smooth surface from a planar base, and include, but are not limited to, a hemisphere shape, a low profile sphere shape (e.g., the height of the profile is less than the radius of the base in the case of a circular base), or a torus shape. Preferably, the modified dome shape is a low profile sphere shape, such as that shown in FIG. 1*b*.

Figure 2:
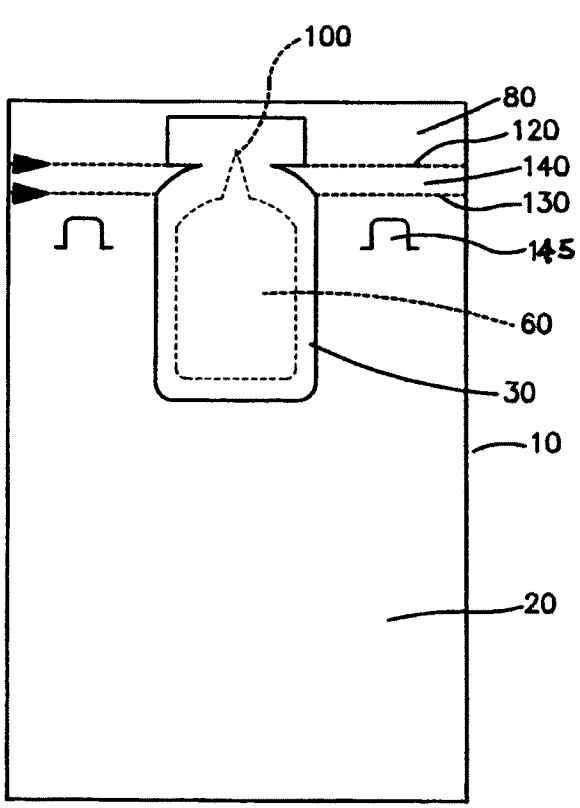
FIG. 2 is a plan view of a second embodiment of a unitized package with a reclosable fluid vessel.

The planar base of the modified dome shape may have any desired shape, preferably a rounded shape, and any desired dimensions. The modified dome shape in FIG. 1*a* has a circular base. Other suitable bases of the modified dome shape include, but are not limited to, ovals, ellipses or simple squares or rectangles with soft radius corners (as shown in FIG. 2).

Any portions of the first laminate barrier layer that do not have the formed modified dome shape (i.e., the portions surrounding the planar base of the formed shape) are preferably planar. Preferably, the second laminate barrier layer is also planar.

The product material may be any material that is suitable to be packaged and distributed in a unitized package. Preferably, the product material is a substantially unadulterated cosmetic, personal care product, medical product, or household product. Examples include face cream, shampoo, toothpaste, liquid medicine, and detergent. Substantially unadulterated products include any product materials presented in their original or natural form, without being altered in any significant way. The product material may be presented in any suitable form, such as in a gel form, in a powder form, in microcapsules, contained in a matrix material, or, preferably, in a liquid form. In addition, the product material may comprise volatile and/or non-volatile components. The quantity or volume of the product material may be suitable as a sample, or for single or multiple uses.

Preferably, the product material substantially fills the volume defined by the modified dome shape of the first laminate barrier layer.

The first and second laminate barrier layers 40 and 50 are sealed together at their perimeters. As shown in FIG. 1*b*, the inner surface 42 of the first laminate barrier layer 40 and the inner surface 52 of the second laminate barrier layer 50 are sealed together at their perimeters, forming a fluid-tight enclosure 60 for containing the product material 70. The seal may be formed using any suitable method, such as by heat sealing, by radio frequency or sonic energy, or by adhesives. Preferably, the seal is a hermetic permanent seal. Permanent seals, also referred to as destruct or tear bonds, may be formed by the methods described above.

Adhesives must be compatible with the product material, i.e., they should not react or become plasticized when they come into contact with the product material or components of the product material. Such reaction may cause undesirable deterioration of the product material or the seal.

In one embodiment, at least one of the inner surfaces 42 and 52 comprises a pressure sensitive adhesive, such as a low odor pressure sensitive adhesive that has been applied from a water borne emulsion. The pressure sensitive adhesive may cover the entire contact area between the first laminate barrier layer and the second laminate barrier layer. Alternatively, the adhesive may be applied in a specific pattern of lines or dots. Another example is specialty grades of hot melt adhesive, especially those that can provide a cross link functionality. Also, adhesives may be formulated to provide additional barrier properties. Such adhesives may contain agents such as oxygen scavengers or consist of film-forming precursors of high-barrier materials, such as latex-grade polyvinylidene chloride (PVdC).

If a permanent seal is used, the unitized package 10 also must be provided with a means for opening the fluid vessel 20, such as by tearing one of the first laminate barrier layer or the second laminate barrier layer, or both. The opening means may include a dispensing tip 100 as shown in FIG. 1*a*, a notch or a string to originate or facilitate the tear. The opening means may also be reclosable or resealable.

When the first and second laminate barrier layers 40 and 50 are sealed together at their perimeters to form a fluid-tight enclosure 60, the product material 70 substantially fills the volume of the enclosure (i.e., the volume defined by the modified dome shape of the first laminate barrier layer), and leaves minimal head space (i.e., the space that is occupied by ambient air) in the enclosure. By utilizing the defined volume of the enclosure to the fullest extent, maximum stability of the contained product material may be achieved. Also, the product material, especially when in fluid form, and other fluids (i.e., liquid or gas) in the enclosure if any, provide internal pressure and force to sustain the formed shape of the first laminate barrier layer. Thus, when the fluid vessel is sealed, the formed modified dome shape of the first laminate barrier layer is resiliently sustainable, i.e., the layer will show minor pressure deformation when force is applied to its outer surface, but will substantially self restore to its original shape on release of the force. Also once formed and sealed, the fluid vessel is resistant to flexing and may contribute to the rigidity of the base card.

In a preferred embodiment, the inner surface 42 of the first laminate barrier layer 40 is heat sealed to the inner surface 52 of the second laminate barrier layer 50 prior to bonding the fluid vessel 30 to the base card 20.

The outer surface 54 of the second laminate barrier layer 50 is permanently bonded to a portion of the base card 20. The second laminate barrier layer may be bonded with a laminating adhesive, or by any other suitable attachment means, such as by adhesives activated by heat, moisture, pressure, drying or radiation curing. In one embodiment, a full bleed adhesive system is incorporated into the outer surface 54 of the second laminate barrier layer 50. Preferably, the full bleed adhesive system comprises a permanent pressure sensitive adhesive such as a permanent pressure sensitive acrylic adhesive. The permanent pressure sensitive adhesive may be covered and protected by a release liner such as a disposable silicone coated release liner.

Any desired material may be used for fabricating the base card. Since the enclosure formed by the first and second laminate barrier layers is fluid tight and also is preferably formed prior to bonding to the base card, the base card material will not be exposed to the product material contained in the enclosure; nor will it be exposed to the heat or other energies used for sealing the first and second laminate barrier layers. Suitable materials for the base card include but are not limited to paper such as cover grade or light gage tag stock. Synthetic paper or other plastic materials may also be used Preferably, the base card comprises a paper stock for environmental reasons and overall cost efficiency. Paper of varying grades and compositions, including recycled, colored, textured, coated, or uncoated, may be used. In one embodiment, the base card is fabricated from grades of solid bleached sulfite paperboard or coverstocks, and has a thickness in the range of about 0.006 inches to about 0.024 inches. The base card may also be coated with various water based or energy cured polymer coatings, or overlaminated with thermoplastic films to protect the paper and any printed graphics from humidity damage.

Preferably, the base card has a sufficiently large surface area extending beyond the fluid vessel so that any desired advertising artworks, texts, graphics, product information or instructions, or drug ingredient information may be printed on any surface of the base card. Also, the fluid vessel may be positioned or sized such that sufficient surface area on the base card is available to achieve brand promotion, consumer education, or compliance with any applicable regulatory requirements such as those imposed by the U.S. Food and Drug Administration. Since the fluid vessel is permanently bonded to the printed base card, the presence of any product marketing or instructional information printed on the base card is ensured at the time of use.

The printed base card may be of any suitable dimension or configuration as long as there is a planar surface to which the fluid vessel may be permanently bonded. As shown in FIG. 1*a*, the printed base card may be planar. The printed base card may also be scored or otherwise folded to form a common 4 or 6 page format. Such configuration functions to substantially increase the usable surface of the base card, while limiting the finished dimensions. The printed base card may also be folded such that it can stand up vertically. The base card may also comprise a portion of a panel incorporated as a portion of a die cut box or a greeting card. As a further example, the folded base card may provide reduced finished dimensions to facilitate placement of the unitized package into an existing host container or to fall within the scope of desired U.S. Postal mailing dimensions. The base cards may also contain a hang hole for retail peg display purposes.

As shown in FIG. 1*a*, the printed base card 20 may have an opening strip 80 defined by a line of perforation 90 intersecting the dispensing tip 100. When the opening strip 80 is removed by tearing or cutting along the line of perforation 90, the fluid vessel 30 will be opened, thus allowing access to the product material 70.

The fluid vessel 30 may also comprise a planar extension tab 110 which is permanently bonded to the printed base card 20. As shown in FIG. 1*a*, the extension tab 110 is formed from the first laminate barrier layer 40 and the second laminate barrier layer 50. The dispensing tip 100 is enclosed between the lower edge 112 and the upper edge 114 of the extension tab 110. The extension tab 110 overlays the opening strip 80, with its lower edge 112 and the line of perforation 90 on the printed base card 20 being superimposed. Thus, when the base card is torn or cut along the line of perforation 90, the extension tab 110 and the opening strip 80 will both be removed, and the product material 70 may be accessed.

The printed base card may also incorporate a reclosable or resealable feature for the fluid vessel. For example, as shown in FIG. 2, the printed base card has two lines of perforation 120 and 130 intersecting the dispensing tip 100. The first line of perforation 120 defines an opening strip 80 and the second line of perforation 130 defines a folding flap 140. In one embodiment, the distance between the two perforated lines may be any desired distance, but preferably is at least about 0.5 inches. The base card further contains at least one locking tab 145. When an opened unitized package is not in use, the folding flap 140 may be folded along the second line of perforation 130 and inserted under the locking tabs 145, thus preventing the product material 70 from being released from the enclosure 60.

II. Method of Manufacturing the Unitized Packages

The present unitized packages may be manufactured using various methods. The methods generally include the following manufacturing steps: providing a printed base card; forming a fluid vessel; and permanently bonding the fluid vessel to a portion of the printed base card. Generally, the fluid vessel is fabricated by forming a portion of the first lamiante barrier layer into a modified dome shape; depositing the material into the volume defined by the modified dome shape; disposing the second laminate barrier layer on the formed first laminate barrier layer; and sealing the first laminate barrier layer and the second laminate barrier layer together at their perimeters to form a fluid-tight enclosure for containing the product material. The materials described above in Section I for the unitized package may also be used in the method.

The printed base card may be made before or after the fluid vessel is made. Preferably, the printed base card is made prior to the manufacture of the fluid vessel.

As described above, the base card may be fabricated from a variety of substrates, preferably from grades of solid bleached sulfite paperboard or cover stocks. Texts or graphics regarding product information may be printed or otherwise decorated on any surface of the base card using any suitable method. Preferred print methods include, but are not limited to, sheet fed offset, web offset, flexographic and digital imaging. The surface of the printed base card may further be coated with a UV cured polymerization coating, film lamination, or alternate coatings to impart water resistant and improved lay flat character to the base card material.

In one embodiment, the base card is further precision die cut to form a line of perforation or other cut line defining an opening strip that facilitates clean opening of the fluid vessel.

Any suitable method may be used for fabricating the fluid vessel of the present unitized package. The various steps for making the fluid vessel may be performed continuously on different stations of a manufacturing sequence. The fluid vessel may be fabricated individually or, more preferably, in multiple quantities. An example of a method for making multiple fluid vessels is described below.

The first laminate barrier layer 40 of the fluid vessel may be cold formed at the first station of the manufacturing sequence. Any suitable stress force may be used in the cold forming process, e.g., fluid pressure or vacuum. Preferably, the stress force is pressurized gas.

FIGS. 3*a* to 4*c* show an example of an assembly at a first manufacturing station that may be used to form the modified dome shape in the first laminate barrier layer. As shown in FIG. 4*a*, the first manufacturing station is comprised of a high pressure platen assembly with two opposing surfaces, i.e., an upper platen 150 and a lower platen 160. Preferably vertical motion of at least one of the upper or lower platens is provided.

The upper surface of the lower platen 160 comprises a plurality of facings 170 with a uniform profile. Each of the facings contains a cavity 180. FIGS. 3*a*-4*c* show one such facing 170. The facing may be fabricated with any suitable resilient material using any suitable method. Preferably, the facing is fabricated with silicone rubber with a durometer value in the range of about 40 to about 80 and with a thickness in the range of about 0.125 inches to about 0.250 inches. The silicone rubber facing may be used as the lower platen facing or further laminated or otherwise bonded to a pressure resistant and machinable material, e.g., medium density fiberboard (MDF), to form the lower platen facing 170. The thickness of the lower platen facing 170 may be adjusted in accordance with the specific design of the fluid vessel. For example, it is in the range of about 0.125 inches to about 1.0 inches.

The lower platen facing 170 may be cut or otherwise machined to form a plurality of cavities therein. FIGS. 3*a*-4*c* show one such cavity 180. The planar shape of the cavity 180 determines the shape of the base of the formed modified dome shape of the first laminate barrier layer, which includes, but is not limited to, circles, ovals, ellipses or squares or rectangles with soft radius corners. The side wall 182 of the cavity 180, generally a simply cut perpendicular to the planar surface of the lower platen 160, does not contact the formed shape of the first laminate barrier layer and therefore need not be polished. The cavity in the lower platen facing functions in lieu of a forming die otherwise utilized in conventional thermoforming processes.

Figure 3A:
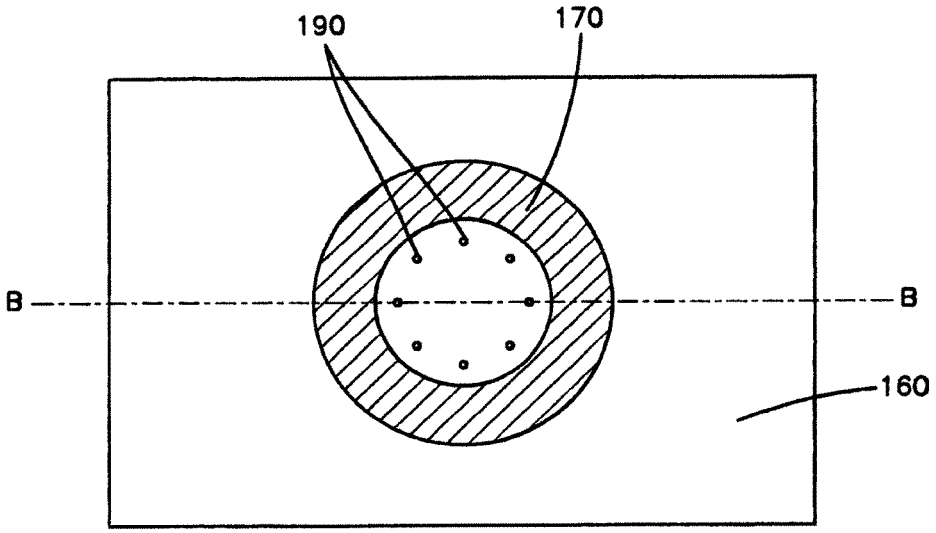
FIG. 3*a* is a plan view of a lower platen for fabricating the first laminate barrier layer of the unitized package.
Figure 3B:
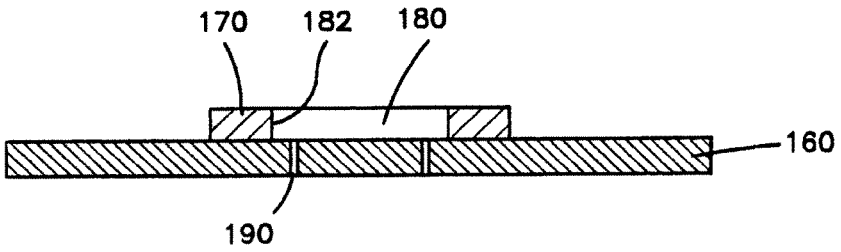
FIG. 3*b* is a cross-sectional view of the lower platen of FIG. 3*a* along B-B.

The lower surface of the lower platen facing 170 is constructed to facilitate limited flow of air between the lower platen facing 170 and the lower surface of the lower platen 160. As shown in FIGS. 3*a* and 3*b*, each lower platen facing 170 may comprise one or more vent holes 190.

Figure 4A:
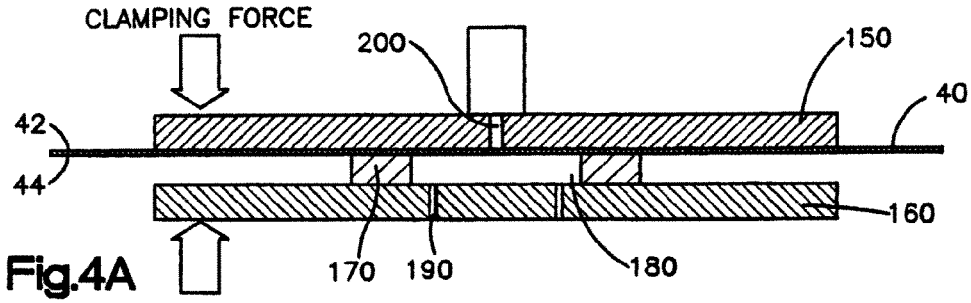
FIG. 4*a* is a side view of a lower platen and an upper platen for fabricating the first laminate barrier layer of the unitized package, before pressurized gas is applied.

As shown in FIG. 4*a*, the upper platen 150 is fitted with air supply channels 200 that correspond with each cavity 180 in the lower platen facings 170.

The preferred manufacturing process uses an intermittent web motion. The first laminate barrier layer 40 is drawn forward into the first station as a planar web in a horizontal orientation. The outer surface 44 of the first laminate barrier layer 40 faces downward and is engaged by the lower platen 160 and the inner surface 42 is engaged by the upper platen 150. The upper platen 150 and lower platen 160 are then engaged by clamping force and the first laminate barrier layer 40 is secured at the perimeters of the cavity 180 of the lower platen facing 170.

Figure 4B:
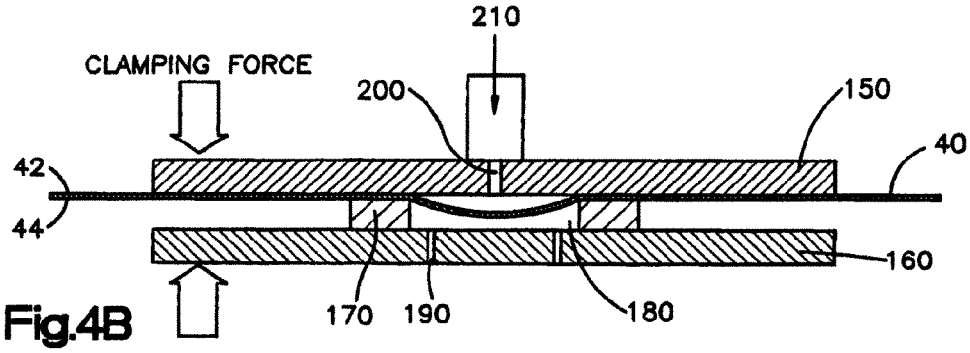
FIG. 4*b* is a side view of the lower and upper platens of FIG. 4*a*, when the pressurized gas is initially applied.

Pressurized gas 210 is introduced into the upper platen 150 through the air supply channels 200. As shown in FIG. 4*b*, as the fluid gas pressure imposed on the inner surface 42 of the first laminate barrier layer 40 builds up (the presence of the vent holes 190 on the lower platen facing 170 relieves or reduces any opposing pressure), the portion of the first laminate barrier layer 40 within the side wall 182 of the cavity 180 starts to deform under stress and bulges into the cavity 180 to form a modified dome shape. The gas pressure is controlled such that the corresponding stress force does not exceed the ultimate tensile strength of the biaxially oriented thermoplastic polymer. As such, the deformation does not significantly alter the desirable physical properties of the original biaxially oriented thermoplastic polymer; instead, it increases the degree of polymer orientation.

A suitable gas pressure is in the range of about 10 psi to about 140 psi, preferably in the range of about 40 psi to about 100 psi. Under such pressure, the first laminate barrier layer comprising a biaxially oriented thermoplastic polymer layer can undergo further biaxial elongation typically in the range of about 10 to about 25% before reaching its breaking point.

Figure 4C:
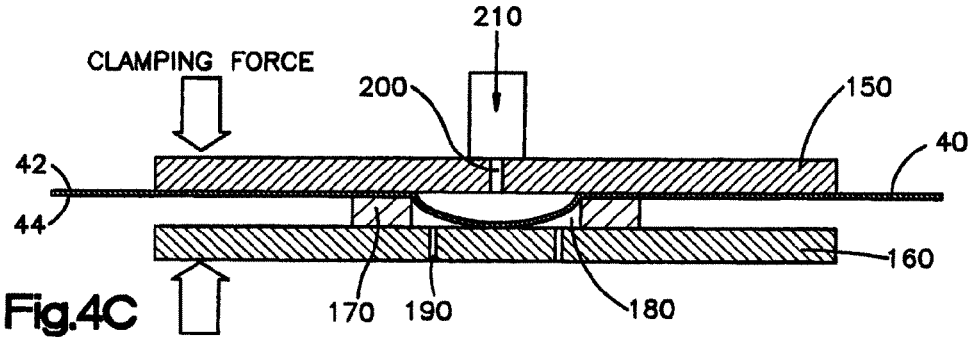
FIG. 4*c* is a side view of the lower and upper platens of FIG. 4*a*, when the pressurized gas is fully applied.

In FIG. 4*c*, the gas pressure is fully applied. After the pressure reaches its desired level, the pressurized gas 210 is switched off and the pressure is removed. Minor shrinkage of the formed fluid vessel profile may subsequently occur due to partial elastic recovery of the biaxially oriented thermoplastic polymer. This partial recovery is not detrimental to the resulting profile.

The modified dome shape formed under the present process has a large radius curvature extending from the planar base where the first laminate barrier layer is located prior to the forming process. The maximum depth of draw is highly influenced by the geometric shape of the original plane area subject to the forming process (i.e., the planar shape of the cavity 180). Therefore, the formed shape of the first laminate barrier layer is a result of the response of the planar laminate film to the internal pressure. Moreover, this formed shape is resiliently sustained until time of use by the internal gas or fluid inflation provided by the product materials and ambient air enclosed in the fluid vessel, without the need for any rigid vertical oriented sidewalls to impart structural strength. Other portions of the first laminate barrier layer that have not been subject to the forming process remain planar.

The use of a biaxially oriented thermoplastic polymer and pressurized gas allows for controlled redistribution of the stress force with progressive polymer chain slip and prohibits mechanical "hot spots" that would otherwise weaken the film or cause ultimate failure. Additionally, as the biaxially oriented thermoplastic polymer is elongated under tensile stress, resistance to further elongation is increased. The increased degree of orientation and resistance to further elongation is also biaxial in nature. As a result, the stressed polymer uniformly redistributes the tensile strain and prevents thinning of the polymer that would otherwise occur. Biaxially oriented PET, with its closely comparable mechanical values in the machine and cross machine directions, is a preferred biaxially oriented polymer. The use of resilient rubber on the lower platen facing also prevents mechanical hot spots or stress points at the perimeter of the cavity 180 that may otherwise lead to stress failure. The present process eliminates complications and quality issues such as buckling, wrinkling or tearing commonly associated with the stretch methods commonly used in forming processes.

As described above, a thin gage metal layer, such as an aluminum layer, may also be incorporated in the first laminated barrier layer. The presence of a biaxially oriented thermoplastic polymer in the same laminate barrier layer as the aluminum layer also prevents cracking or tensile failure of the gage metal during the forming process as it distributes the stress force during the forming process and prevents localized metal elongation to the point of failure.

Other suitable methods may be used to apply pressure to the first laminate barrier layer to form the modified dome shape therein.

Subsequent to forming, the upper platen 150 is lifted and the formed first laminate barrier layer 40 is advanced to the second station of the manufacturing sequence where the product material 70 is filled. For example, the product material 70 may be metered and discharged from fluid nozzles mounted directly over the volume defined by each of the modified dome shapes. Metering and pumping may take place while the intermittent web motion is stopped and may be accomplished through the use of a variety of suitable pumping and metering systems. The product material dispensed preferably substantially fills the volume of the formed modified dome shape. Leveling of the product material is not required and higher viscosity product material may temporarily stand above the plane of the inner surface 42 of the first laminate barrier layer 40. Also, disposing the product material in the formed modified dome shape may prevent unwanted outward spread of the product material, otherwise occurring due to momentum associated with the preferred intermittent web motion process.

At the next manufacturing station, a planar second laminate barrier layer 50 is then disposed on the inner surface 42 of the first laminate barrier layer 40. Preferably, the second laminate barrier layer 50 comprises a pressure sensitive adhesive on its inner surface 52, which is covered and protected by a silicone coated disposable release liner (not shown). The first and second laminate barrier layers 40 and 50 are then indexed and moved forward to a heated platen where these two layers are sealed together at their perimeters to form a fluid-tight enclosure 60. The product material 70 is automatically smoothed and redistributed in the enclosure 60 by the planar inner surface 52 of the second laminate barrier layer 50 just prior to or during the heat seal process. In a preferred embodiment, a dispensing tip 100 is formed through the use of a simple machined relief in the lower surface of the heated upper platen. The remaining sealing takes place in such a manner that only the planar portion of the first laminate barrier layer is sealed and the modified dome shape is not disturbed.

The sealed first and second laminate barrier layers are then precision die cut to form individual fluid vessels. In a preferred method, the first and second laminate barrier layers are kiss cut together with a full bleed permanent pressure sensitive adhesive such as a permanent pressure sensitive acrylic adhesive against a release liner such as a disposable silicone coated release liner. The individual fluid vessels are mounted in a predetermined pattern on the disposable silicone coated release liner. The fluid vessels are generally not flexible when sealed.

The fluid vessel is then permanently bonded to the printed base card. This step may be accomplished by any suitable method. In a preferred embodiment, the disposable silicone coated release liner is removed and the second laminate barrier layer is bonded to the base card by the full bleed permanent pressure sensitive acrylic adhesive.

The present unitized package may be used as a product for single use or multiple uses. It may also be used as a sampling package. A consumer may open the fluid vessel, for example, by tearing off the opening strip along the line of perforation on the base card. The product material may then be dispensed by gently applying pressure on the outer surface of the first laminate barrier layer. Because the line of perforation provides a clean opening point of the fluid vessel, the product material may be dispensed in a controlled manner. Alternate methods of opening the fluid vessel include, but are not limited to; tear strings, peel off tabs, scoring of one or both of the laminate barrier layers such as with lasers, peel off header strips or frangible or peelable perimeter seals. Additionally, since the fluid vessel is permanently bonded to the printed base card, any marketing or product information printed on the base card is readily available at the time of use.

The description contained herein is for purposes of illustration and not for purposes of limitation. Changes and modifications may be made to the embodiments of the description and still be within the scope of the invention. Also, all references cited above are incorporated herein, in their entirety, for all purposes related to this disclosure.

I claim:

1. A method of manufacturing a unitized package comprising a printed base card and a fluid vessel, comprising:

(a) providing a printed base card;

(b) forming a fluid vessel by:

(i) forming a portion of a first laminate barrier layer of the fluid vessel into a modified dome shape with a defined volume by biaxial elongation of the first laminate barrier layer, wherein the first laminate barrier layer comprises at least one layer of a biaxially oriented thermoplastic polymer and a portion that is planar;

(ii) depositing a product material onto the first laminate barrier layer such that the product material substantially fills the defined volume;

(iii) disposing a second laminate barrier layer of the fluid vessel on the first laminate barrier layer, wherein the second laminate barrier layer is planar;

(iv) sealing the first and second laminate barrier layers together at their perimeters to form a fluid-tight enclosure for containing the product material; and (c) permanently bonding the second laminate barrier layer of the fluid vessel to a portion of the printed base card.

2. The method of claim 1, wherein the modified dome shape of the first laminate barrier layer is resiliently sustainable when the fluid vessel is sealed.

3. The method of claim 1, wherein the biaxially oriented thermoplastic polymer comprises one or more of a polyethylene, a polypropylene, a polyester, a polyamide, a polyacrylate, or a mixture thereof.

4. The method of claim 3, wherein the biaxially oriented thermoplastic polymer comprises a polyethylene terephthalate.

5. The method of claim 1, wherein one or both of the first and second laminate barrier layers comprise a layer of aluminum foil.

6. The method of claim 5, wherein the aluminum foil is less than about 0.001 inches in thickness.

7. The method of claim 1, wherein the first and second laminate barrier layers are sealed together by heat sealing.

8. The method of claim 1, wherein the first and second laminate barrier layers are sealed together with an adhesive.

9. The method of claim 1, wherein step (i) comprises applying gas pressure to the first laminate barrier layer to form the modified dome shape.

10. The method of claim 9, wherein the gas pressure is about 10 psi to about 140 psi.

11. The method of claim 9, wherein the gas pressure is applied for a time period ranging from about 0.01 seconds to about 1 seconds.

12. The method of claim 1, wherein the fluid vessel comprises a dispensing tip.

13. The method of claim 12, further comprising die cutting the base card to form an opening strip defined by a first line of perforation, wherein the line of perforation intersects the dispensing tip.

14. The method of claim 13, wherein the first and second laminate barrier layers are sealed together at their perimeters to form the fluid-tight enclosure and a planar extension tab, wherein the planar extension tab encloses the dispensing tip and overlays the opening strip.

15. The method of claim 13, wherein the base card comprises a second line of perforation intersecting the dispensing tip, in which the second line of perforation defines a folding flap.

16. The method of claim 15, wherein the base card comprises one or more locking tabs under which the folding flap may be inserted.

17. The method of claim 12, wherein the dispensing tip is reclosable.

18. The method of claim 1, wherein the base card is less flexible than the first laminate barrier layer.

19. The method of claim 1, wherein the base card comprises a paper stock.

* * * * *